US007946655B2

(12) United States Patent
Hsu

(10) Patent No.: US 7,946,655 B2
(45) Date of Patent: May 24, 2011

(54) SEAT CUSHION STRUCTURE

(76) Inventor: Tsung-Yung Hsu, Taichung (TW)

( * ) Notice: Subject to any disclaimer, the term of this patent is extended or adjusted under 35 U.S.C. 154(b) by 36 days.

(21) Appl. No.: 12/481,842

(22) Filed: Jun. 10, 2009

(65) Prior Publication Data

US 2010/0314929 A1 Dec. 16, 2010

(51) Int. Cl.
*A47C 7/02* (2006.01)
*A47C 16/00* (2006.01)

(52) U.S. Cl. ..... 297/452.46; 5/652.1

(58) Field of Classification Search ..... 297/452.21, 297/452.23, 452.25, 452.26, 452.28, 452.42, 297/452.46, 452.47, 452.48; 5/652, 652.1, 5/421

See application file for complete search history.

(56) References Cited

U.S. PATENT DOCUMENTS 3,818,522 A * 6/1974 Schuster ..... 5/652.1
5,294,181 A * 3/1994 Rose et al. ..... 297/452.25
7,426,767 B2 * 9/2008 Mossbeck ..... 5/736
2005/0022305 A1 * 2/2005 Bieganek et al. ..... 5/630
2009/0013472 A1 * 1/2009 Koffler et al. ..... 5/652.1
2009/0058167 A1 * 3/2009 San Miguel et al. ..... 297/452.48

* cited by examiner

*Primary Examiner* — Milton Nelson, Jr.

(57) ABSTRACT

A seat cushion structure is formed by combining upper and lower substrates made of a soft elastic material. Recessed spaces are formed on the upper and lower substrates respectively. Protrusions are formed in the recessed spaces. A flow passage is formed between every two protrusions. An inwardly concave air chamber is evacuated from each protrusion within a contact range of supporting a sitter's buttock. A shallow cut groove is formed on a side of the inwardly concave air chamber. A concave arc form corresponding to the shape of the buttock is disposed on an external surface of the upper substrate in contact with the buttock, such that when the upper and lower substrates are combined integrally, the protrusion of the upper substrate is disposed precisely above an upper periphery of the inwardly concave air chamber of the protrusion of the lower substrate.

1 Claim, 7 Drawing Sheets

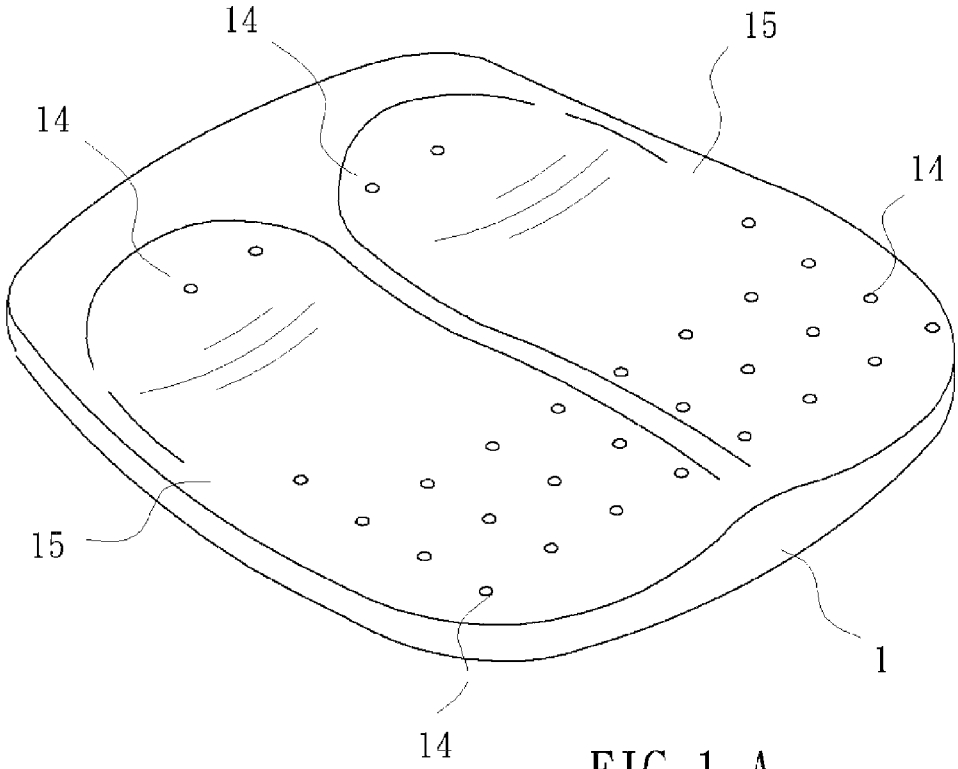
FIG. 1-A
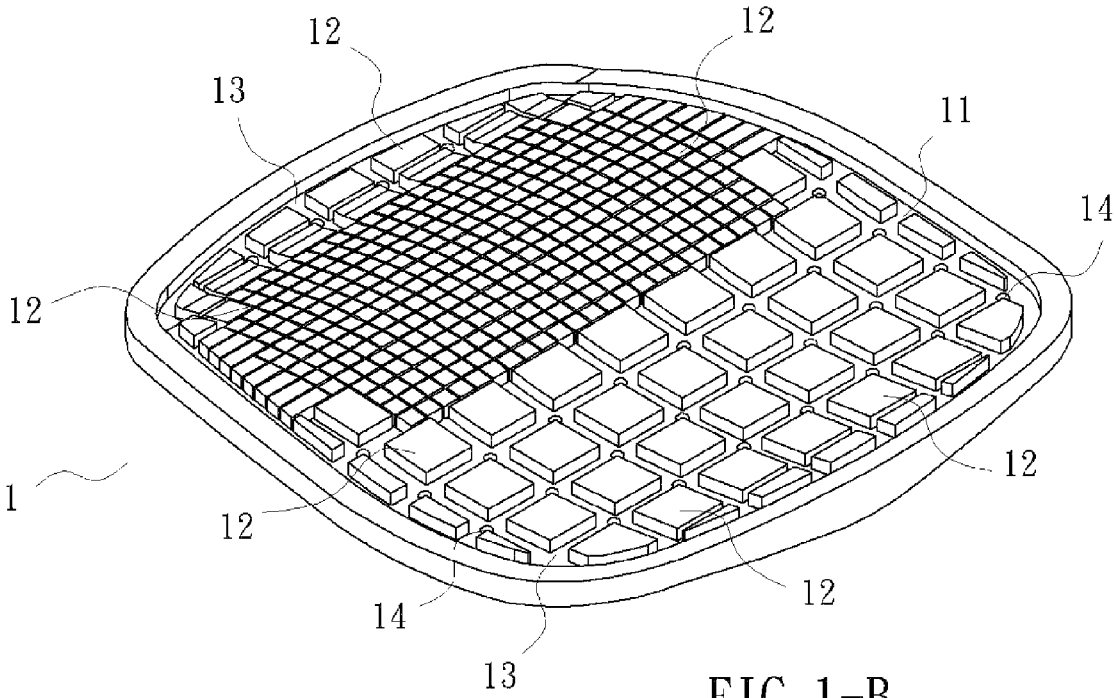
FIG. 1-B

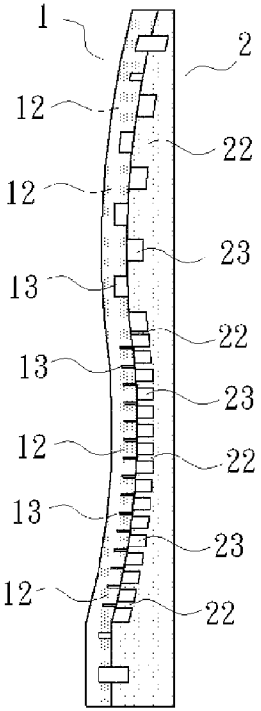
FIG. 4-C
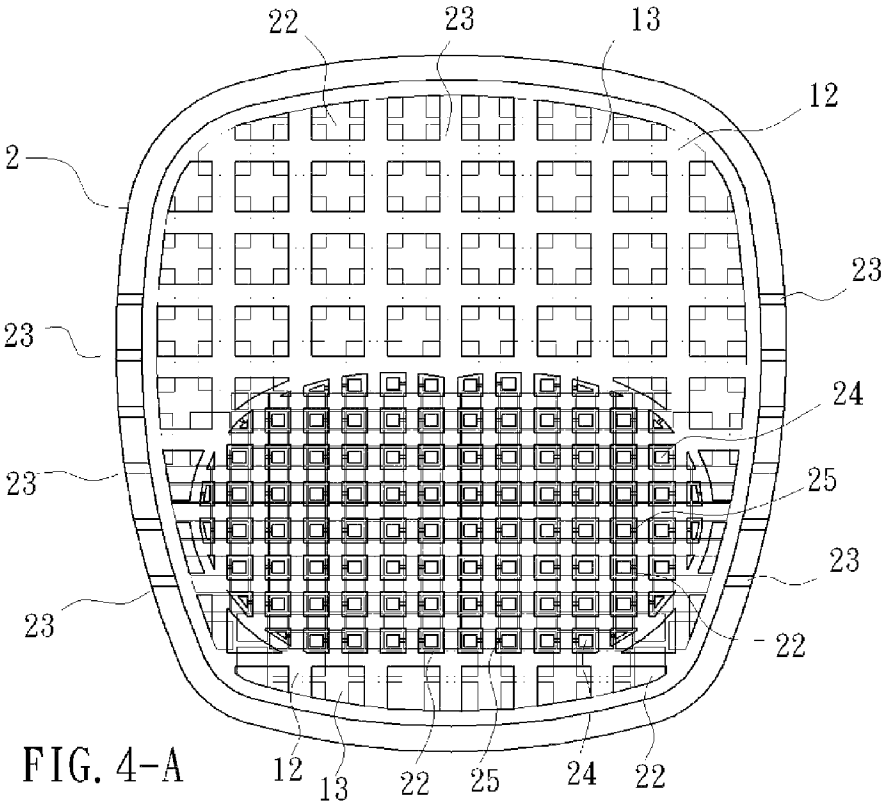
FIG. 4-A
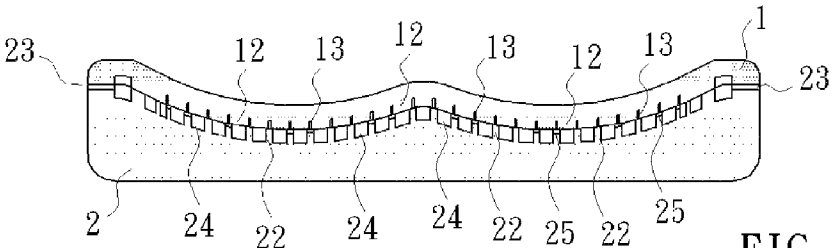
FIG. 4-B

SEAT CUSHION STRUCTURE

BACKGROUND OF THE INVENTION

1. Field of the Invention

The present invention relates to a seat cushion structure, in particular to a seat cushion structure formed by combining upper and lower substrates made of a soft elastic material, and after the two substrates are attached with each other, a protrusion at the upper substrate is situated precisely above an upper periphery of an inwardly concave air chamber of a protrusion of the lower substrate, such that when a user sits on the seat cushion, a vast majority of the user's body weight is exerted onto the position of the user's buttock, and the design of producing different supporting forces is provided for supporting the user's body weight by the protrusions at different positions in the upper and lower substrates, and damping forces produced by the air chambers are provided for protecting buttock bones and an ergonomic form produced by different deformation forces of the air chambers can prevent the user's muscles from being ached or injured by excessive deformations, and the design of the air chambers and ventilation holes can dissipate the user's body heat through a flow passage along the periphery of the protrusions, while achieving the effects of pressure dispersion, ventilation, uniform support and protection.

2. Description of the Related Art

In general, a seat cushion structure emphasizes on its manufacture by a special advanced material with good ventilation and comfort. However, most seat cushions available in the market are made of foams with different levels of hardness. Although such arrangement can make some changes to the stylish appearance of the seat cushion, yet the density of the foams is equal and thus such seat cushion is unable to cope with a pressure change of the user's buttock when the user is sitting on the seat cushion. In other words, a vast majority of the user's body weight is exerted at the position of the user's buttock when the user is sitting on the seat cushion. Particularly, the largest force exerted on the buttock is concentrated at the position of the user's pelvic girdle, and a smaller force is exerted at the periphery of the buttock, so that the general seat cushion structure is insufficient to provide support for such pressure change, and the deformation of the buttock becomes larger. As a result, the seat cushion not only fails to eliminate a sitter's fatigue or relax the user's body, but also makes the sitter tired when sitting for a long time, and even worse, it may cause injuries to the buttock muscles or aches and pathological changes such as bone deformations, etc.

SUMMARY OF THE INVENTION

In view of the aforementioned problems, the inventor of the present invention conducted extensive researches and experiments, and finally developed a seat cushion structure in accordance to the present invention to overcome the aforementioned problems.

Therefore, it is an objective of the present invention to provide a seat cushion structure comprising: upper and lower substrates, made of a soft elastic material and combined with one another; recessed spaces, formed on an attached surface of the two substrates; a plurality of protrusions, with different shapes and sizes, and disposed in the recessed space; a flow passage, interconnected between every two protrusions; an inwardly concave air chamber, evacuated from each protrusion within a contact range of supporting a user's buttock; a shallow cut groove, disposed on a side of the inwardly concave air chamber; and a concave arc form, corresponding to the shape of the buttock, and disposed on an external surface of the upper substrate in contact with the buttock, such that when the upper and lower substrates are combined integrally, the protrusion of the upper substrate is disposed precisely above an upper periphery of the inwardly concave air chamber of the protrusion of the lower substrate; and when the user sits on the seat cushion, a design of producing different supporting forces by the protrusions at different positions in the upper and lower substrates is provided for supporting the user's body weight, and a damping force produced by the air chamber is provided for protecting the user's buttock bone and an ergonomic form produced by deformation forces of the air chamber is provided for preventing the user's muscles from being ached or injured by an excessive deformation, and the deign of the air chambers and the ventilation holes is provided for dissipating the user's body heat from a flow passage around the periphery of the protrusions to the outside, so as to achieve the effects of pressure dispersion, ventilation, uniform support and protection.

Another objective of the present invention is to provide a seat cushion structure, wherein a plurality of protrusions formed in the recessed space which is disposed on an attached surface of the upper and lower substrates are lumps of different shapes and sizes.

Another objective of the present invention is to provide a seat cushion structure, wherein a plurality of protrusions formed in the recessed space which is disposed on an attached surface of the upper and lower substrates are set in a range of different lumps to produce different levels of deformations and ventilation effects.

Another objective of the present invention is to provide a seat cushion structure, wherein a plurality of protrusions formed in the recessed space which is disposed on an attached surface of the upper and lower substrates are designed with a combination of lumps with different densities to produce different levels of deformations and ventilation effects.

Another objective of the present invention is to provide a seat cushion structure, wherein the protrusion formed in the recessed space of the lower substrate and within a contact range of supporting the sitter's buttock is an evacuated inwardly concave air chamber, such that when the upper and lower substrates are combined integrally, the protrusion of the upper substrate is disposed precisely above an upper periphery of the inwardly concave air chamber of the protrusion of the lower substrate, and when the sitter's buttock is in contact with the upper substrate, the upper substrate is pressed onto the lower substrate, such that the lower substrate provides an elastic effect by means of the inwardly concave air chamber of the plurality of protrusions, so as to achieve the effect of absorbing and damping the pressure exerted onto the seat cushion.

Another objective of the present invention is to provide a seat cushion structure, wherein the protrusion formed in the recessed space of the lower substrate and within a contact range of supporting the sitter's buttock is an evacuated inwardly concave air chamber, and a shallow cut groove is formed on a side of the inwardly concave air chamber for releasing the force and achieving the heat dissipating effect.

Another objective of the present invention is to provide a seat cushion structure, wherein the design of a flow passage formed between a plurality of protrusions in the recessed spaces of the upper and lower substrates gives different supporting forces to the seat cushion for supporting a sitter's body weight, dissipating the sitter's body heat appropriately to the outside, and providing a ventilation effect.

Another objective of the present invention is to provide a seat cushion structure, wherein a flow passage is formed between a plurality of protrusions in the recessed spaces of the upper and lower substrates, and penetrating ventilation holes are provided for enhancing the ventilation effect by dissipating a sitter's body heat to the outside.

Another objective of the present invention is to provide a seat cushion structure, wherein a concave arc form corresponding to the shape of the buttock is disposed on an external surface of the upper substrate in contact with the buttock to comply with an ergonomic design for a comfortable seat and reduce the pressure exerted onto a sitter's buttock.

BRIEF DESCRIPTION OF THE DRAWINGS

FIG. 1A is a front view of an upper substrate of the present invention;

FIG. 1B is a rear view of an upper substrate of the present invention;

FIG. 4A is a first schematic view of the present invention after being combined;

FIG. 4B is a second schematic view of the present invention after being combined;

FIG. 4C is a third schematic view of the present invention after being combined;

DETAILED DESCRIPTION OF THE PREFERRED EMBODIMENTS

Figure 2:
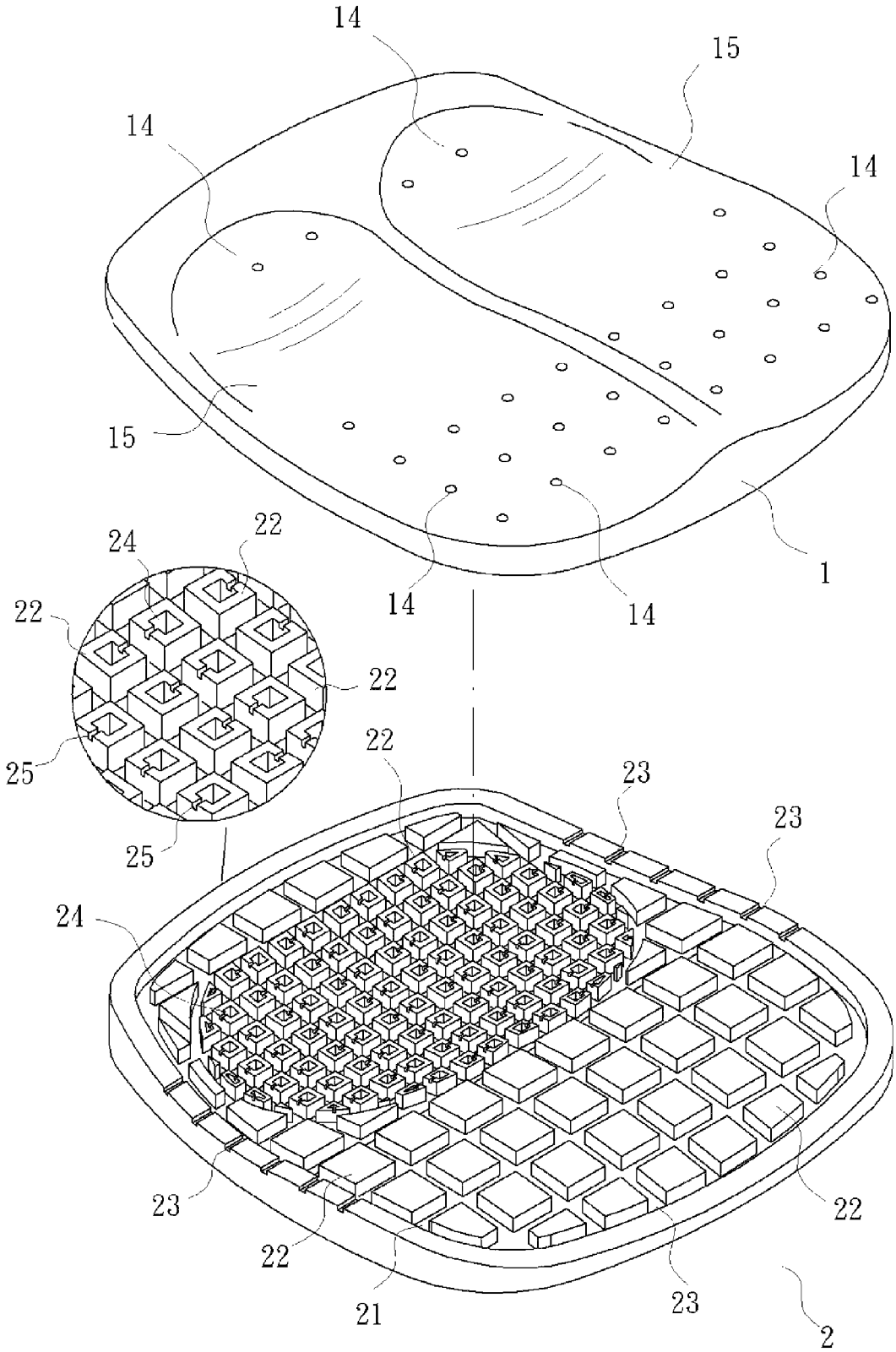
FIG. 2 is a first schematic view of assembling the present invention.
Figure 3:
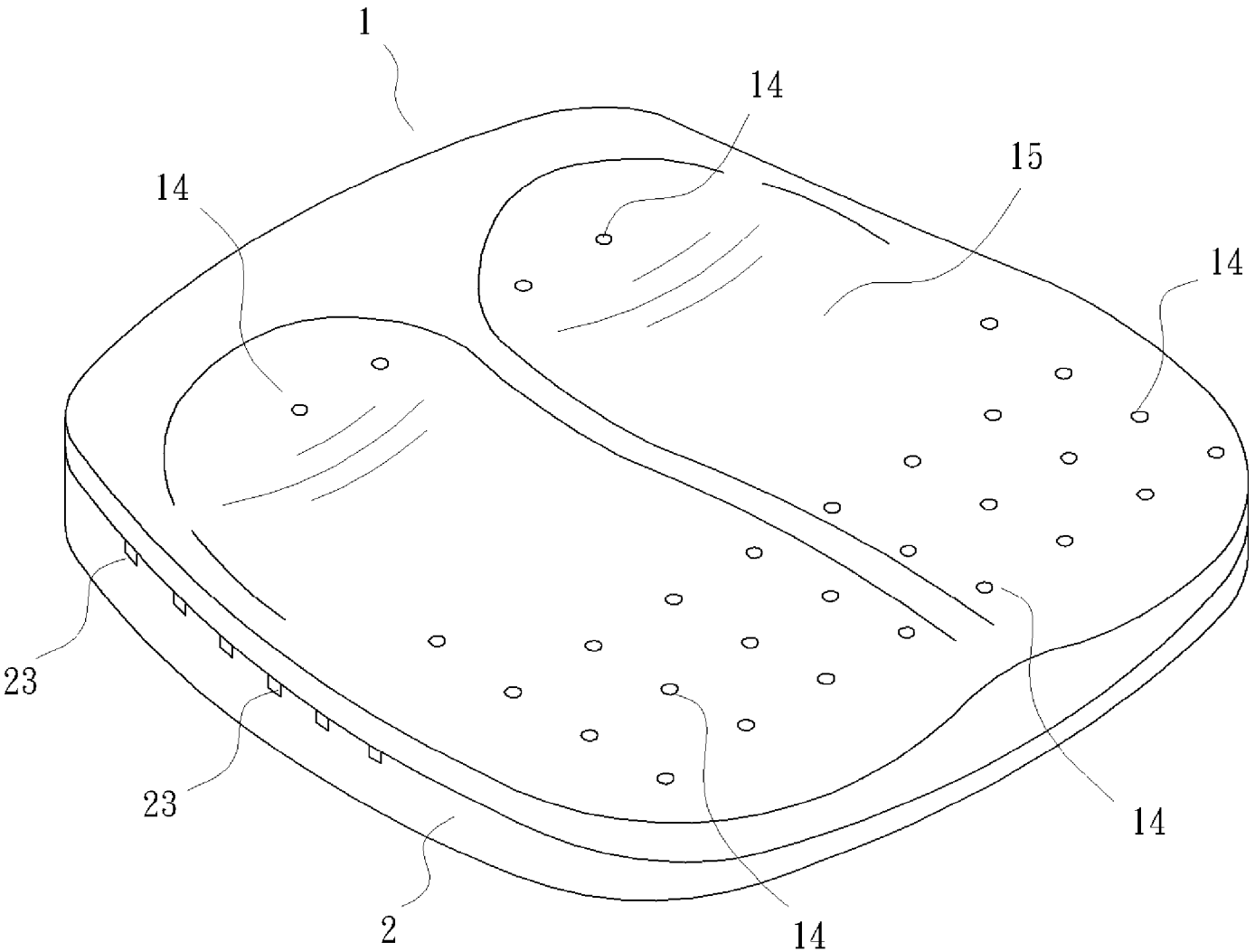
FIG. 3 is a second schematic view of assembling the present invention.

With reference to FIGS. 1A, 1B, 2 and 3 for the detailed illustration of a seat cushion structure in accordance the present invention, the seat cushion structure comprises an upper substrate 1 and a lower substrate 2 made of a soft elastic material and combined with each other, and recessed spaces 11, 21 disposed on an attached surface of the two substrates 1, 2, wherein a plurality of protrusions 12, 22 of different shapes and sizes are formed in the recessed space 11, 21, and the protrusions 12, 22 can be made into a different range of blocks with different forms as needed or made by mixing blocks with different densities, and a flow passage 13, 23 is formed between every two protrusions 12, 22, and penetrating ventilation holes 14 are formed in the flow passage 13 for enhancing the ventilation effect, and the protrusion 22 disposed within a contact range in the lower substrate 2 for bearing a sitter's buttock A includes an inwardly concave evacuated air chamber 24, and a shallow cut groove 25 disposed on a side of the inwardly concave air chamber 24, and an external surface of the upper substrate 1 provided for contacting the sitter's buttock A is in a concave arc 15 corresponding to the shape of the buttock A.

Figure 5:
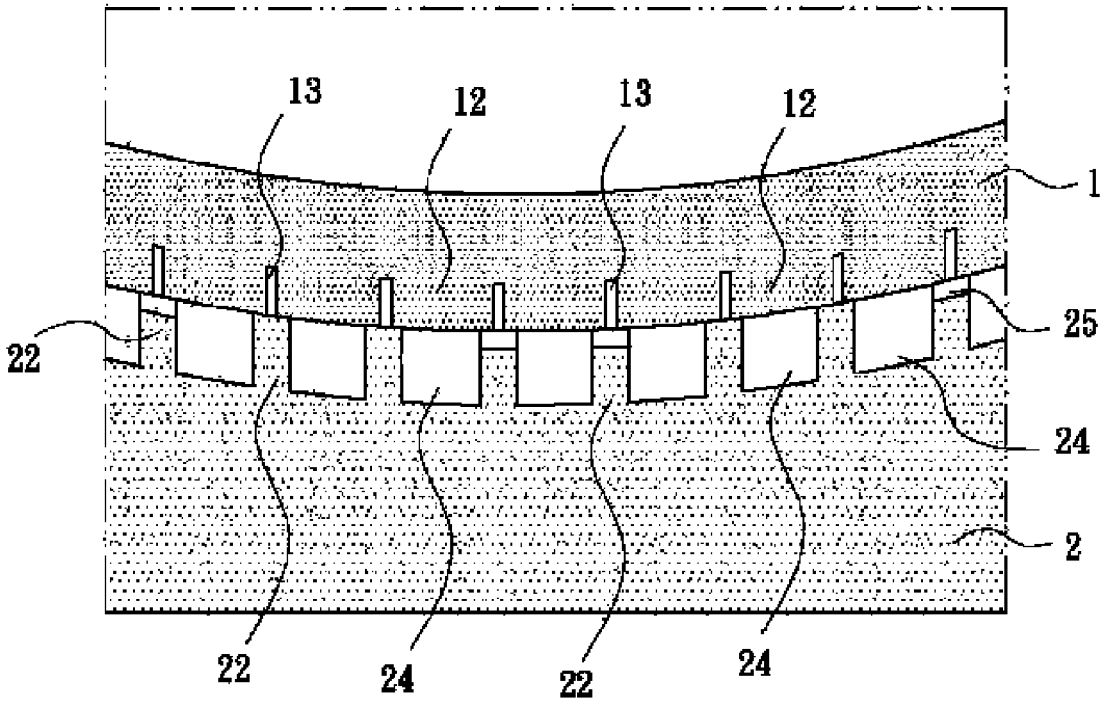
FIG. 5 is an enlarged view of the present invention, while a seat is not occupied.
Figure 8:
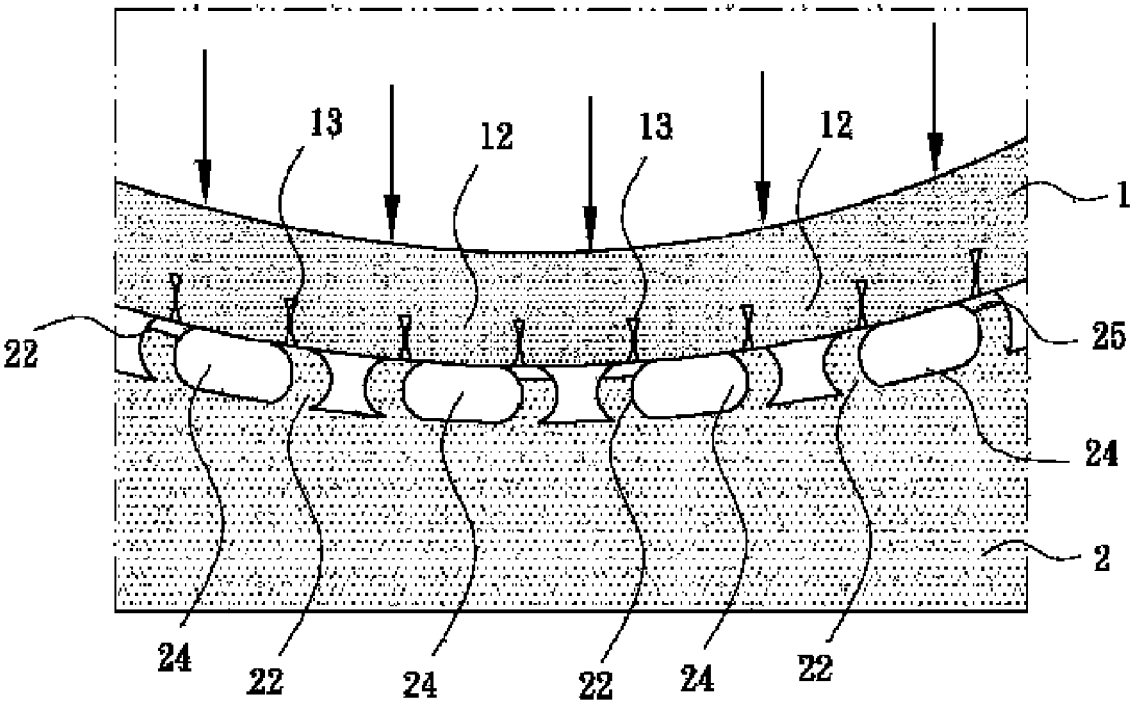
FIG. 8 is a schematic view of a third preferred embodiment of the present invention.
Figure 6:
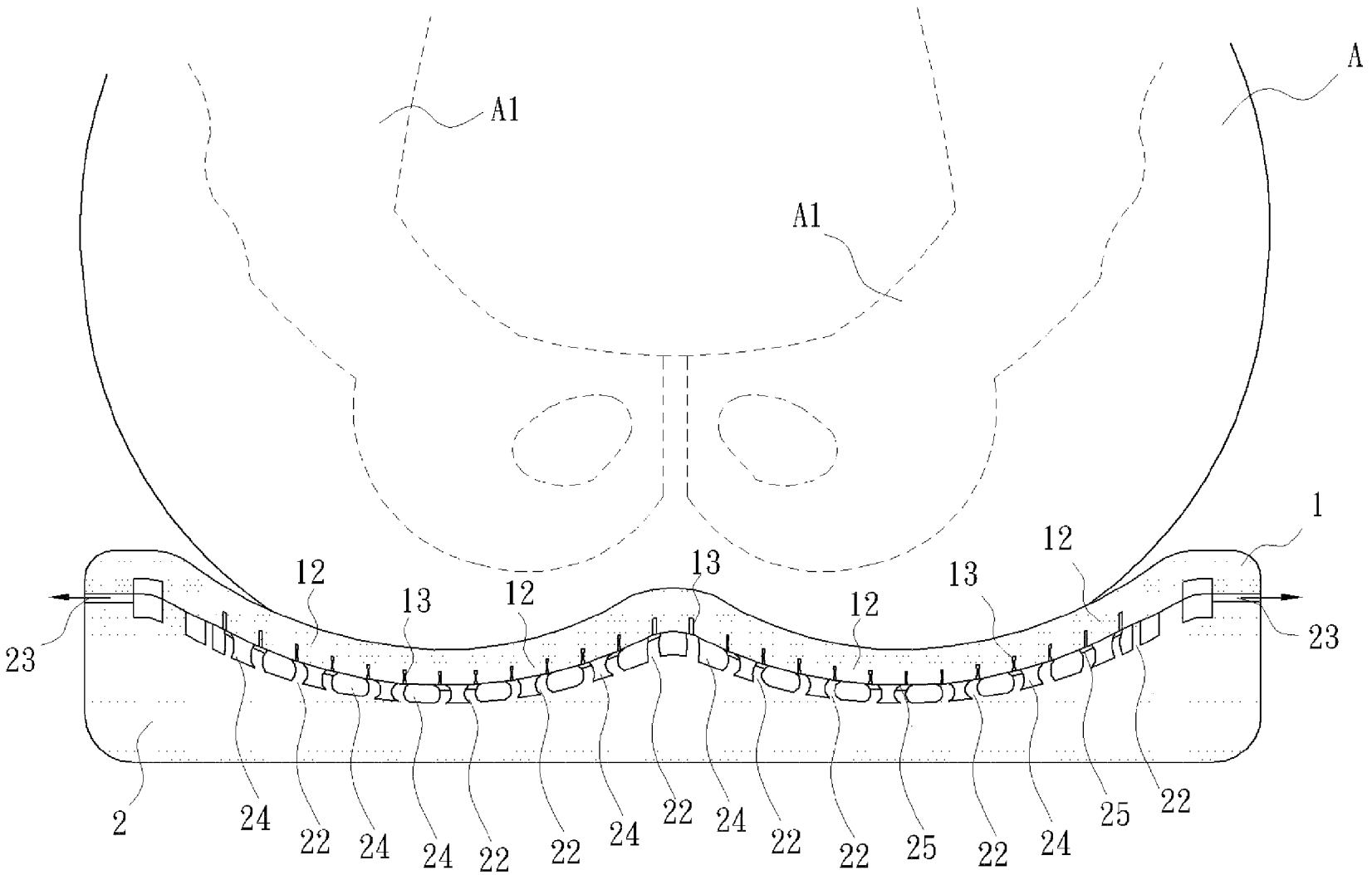
FIG. 6 is a schematic view of a first preferred embodiment of the present invention.
Figure 7:
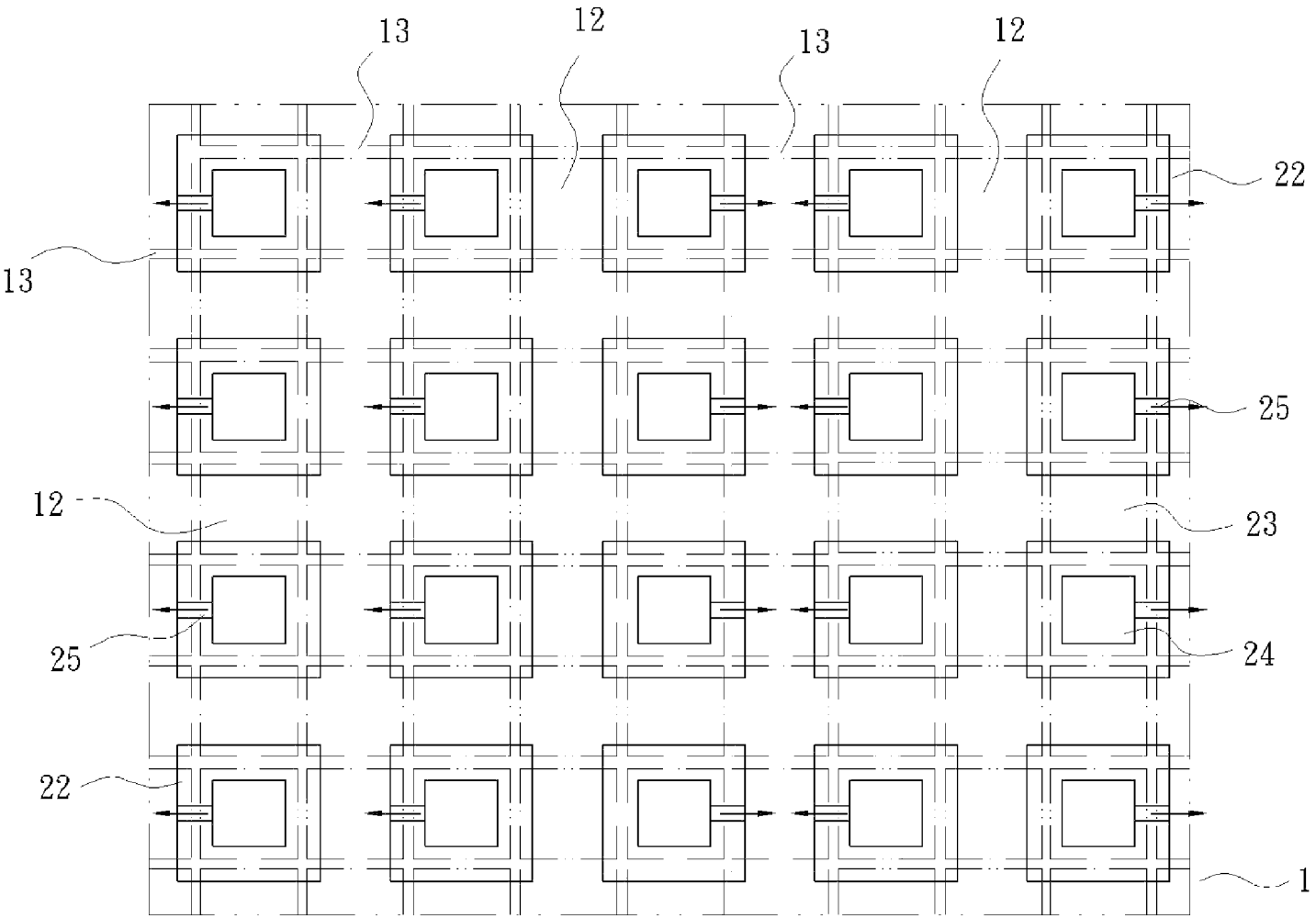
FIG. 7 is a schematic view of a second preferred embodiment of the present invention.

When the upper substrate 1 and the lower substrate 2 are combined with one another (as shown in FIGS. 4A, 4B and 4C), the protrusion 12 of the upper substrate 1 is disposed precisely above the upper periphery of the inwardly concave air chamber 24 of the protrusion 22 of the lower substrate 2 (as shown in FIG. 5), such that when a sitter sits on the seat cushion, and a vast majority of the sitter's body weight is exerted onto the position of the buttock A, the design of the protrusions 12, 22 in the upper substrate 1 and the lower substrate 2 of the seat cushion forces the upper substrate 1 to push the lower substrate 2, so that the lower substrate 2 has the elastic effect through the inwardly concave air chamber 24 of the plurality of protrusions 22 for absorbing and damping the pressure exerted onto the seat cushion (as shown in FIGS. 6 to 8). Therefore, different supporting forces are provided for supporting the weight, and the damping force produced by the inwardly concave air chamber 24 is provided for protecting a sitter's bone A1 of the buttock A, and an ergonomic design with different deformation forces of the inwardly concave air chamber 2 can prevent the sitter's muscles from being ached and injured by an excessive deformation, so that pressure can be released effectively from the sitter's bone A1 of the buttock A to protect the sitter from being injured by the deformation.

With the design of the flow passages 13, 23 interconnected between the plurality of protrusions 12 of the upper substrate 1 and the plurality of protrusions 22 of the lower substrate 2 respectively, and the shallow cut groove 25 disposed on a side of the inwardly concave air chamber 24 of the protrusion 22 in the lower substrate 2, the seat cushion of the invention provides different supporting forces for supporting the sitter's body weight, and dissipating the sitter's body heat appropriately to the outside to give a ventilation effect. Therefore, the invention has a multiple of functions including elasticity, comfortability, ventilation and protection.

In summation of the description above, the present invention improves over the prior art and complies with the patent application requirements, and thus is duly filed for patent application.

What is claimed is:

1. A seat cushion structure, comprising:

upper and lower substrates made of a soft elastic material and combined with one another;

two recessed spaces each formed on an attached surface of each of the upper and lower substrates;

a plurality of protrusions disposed in the recessed space of each of the upper and lower substrates;

a plurality of flow passages each interconnected between every two protrusions;

a plurality of inwardly concave air chambers each formed in the protrusion of the lower substrate;

a plurality of shallow cut grooves each disposed on a side of the inwardly concave air chamber;

a plurality of ventilation holes each formed on an external surface of the upper substrate to communicate with the flow passage; and a two concave members disposed on the external surface of the upper substrate, wherein each of the protrusions under the concave members of the upper substrate is disposed on the inwardly concave air chamber of the protrusion of the lower substrate.

* * * * *